US006920936B2

(12) United States Patent
Sheiretov et al.

(10) Patent No.: US 6,920,936 B2
(45) Date of Patent: Jul. 26, 2005

(54) CONSTANT FORCE ACTUATOR

(75) Inventors: Todor K. Sheiretov, Houston, TX (US); Roger A. Post, Arcanum, OH (US); Carl J. Roy, Richmond, TX (US); Joseph F. Cordera, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 68 days.

(21) Appl. No.: 10/321,858

(22) Filed: Dec. 17, 2002

(65) Prior Publication Data

US 2003/0173076 A1 Sep. 18, 2003

Related U.S. Application Data

(60) Provisional application No. 60/364,189, filed on Mar. 13, 2002.

(51) Int. Cl.[7] ..... E21B 23/00

(52) U.S. Cl. ..... 166/382; 166/206; 166/216; 166/241.1

(58) Field of Search ..... 166/382, 206, 166/216, 241.1, 241.2, 241.3, 241.4, 241.5, 241.6, 241.7; 175/99

(56) References Cited

U.S. PATENT DOCUMENTS 4,033,187 A * 7/1977 Nicolas ..... 73/152.34
4,116,274 A * 9/1978 Rankin et al. ..... 166/250.01
4,184,546 A * 1/1980 Nicolas et al. ..... 166/206
4,926,937 A * 5/1990 Hademenos ..... 166/206
5,758,723 A * 6/1998 Saucier et al. ..... 166/55.8
5,765,640 A * 6/1998 Milne et al. ..... 166/206
5,785,125 A * 7/1998 Royer ..... 166/380
6,629,568 B2 * 10/2003 Post et al. ..... 166/382
2003/0183383 A1 * 10/2003 Guerrero ..... 166/206
2003/0188875 A1 * 10/2003 Bloom et al. ..... 166/382

FOREIGN PATENT DOCUMENTS

EP 1344893 * 9/2003 ..... E21B/23/04

* cited by examiner

*Primary Examiner*—William Neuder
(74) *Attorney, Agent, or Firm*—Wayne Kanak; Robin Nava; Tim Curington

(57) ABSTRACT

A substantially constant force actuator that is applicable to centralizers, anchors and tractors for use in wells and is applicable to lifting devices such as jacks and load supporting devices. One or more sets of linkage arms are angularly movable by the force of one or more force transmitting members from a minimum angle with the force transmitting members at maximum spacing to a maximum angle with the force transmitting members at minimum spacing to impart a substantially constant force to an object or surface, with the direction of the force being substantially perpendicular to the direction of relative linear movement of the force transmitting members. With the linkage arms at their minimum angles, movement control elements on at least one of the force transmitting members react with guide surfaces of the linkage arms to achieve angular linkage movement and to develop a substantially constant force during angular linkage movement.

34 Claims, 8 Drawing Sheets

CONSTANT FORCE ACTUATOR

CROSS-REFERENCE TO RELATED APPLICATIONS

This application claims priority from U.S. Provisional Application No. 60/364,189, filed Mar. 13, 2002, which is incorporated herein by reference.

BACKGROUND OF THE INVENTION

1. Field of the Invention

The present invention relates to mechanisms that employ a force applied in one direction to lift or support a load in a direction perpendicular to the direction of the applied force. Such mechanisms find application in many fields and may be employed, for example, in tools for use in wells or pipes, such as centralizers, calipers, anchoring devices, and tractors. The invention is particularly applicable to the field of tractors for conveying logging and service tools in deviated or horizontal oil and gas wells, or in pipelines, where such tools may not be readily conveyed by the force of gravity. The invention may also be employed in jacking devices.

2. Description of Related Art

After an oil or gas well is drilled, it is often necessary to log the well with various measuring instruments. This is usually done with wireline logging tools lowered inside the well on a logging cable. Similarly, pipelines may require inspection and, therefore, the movement of various measuring tools along the pipe.

Some logging tools can operate properly only if they are positioned at the center of the well or pipe. This is usually done with centralizers. All centralizers operate on the same general principle. Equally spaced, multiple bow springs or linkages of various kinds are extended radially from a central hub toward the wellbore or pipe wall. These springs or linkages come into contact with the wellbore or pipe wall and exert radial forces on it which tend to move the body of the tool away from the wall. Since the bow springs and linkages are usually symmetric with respect to the central hub, they tend to position the tool at the center of the well. Hence, the radial forces exerted by these devices are often referred to as centralizing forces.

Centralizers usually remain open throughout their operation. In other words, their linkages are always biased toward the wellbore wall and they always remain in contact with the wellbore wall. Most centralizers are designed such that they can operate in a large range of wellbore sizes. As the centralizers expand or contract radially to accommodate changes in the size of the wellbore, their centralizing forces may vary. In wells that are nearly vertical, the variation in radial force is not a problem because the radial component of the tool weight is small and even weak centralizers can cope with it. In addition, the centralizing force and the frictional drag resulting from it are such a small fraction of the total tension on the logging cable that its variability can be neglected for all practical purposes.

Wells that have horizontal or highly deviated sections may, however, present problems. In a horizontal section of the well, the centralizer must be strong enough to lift the entire weight of the tool off the wellbore wall. On the one hand, the minimum level of the centralizing force must be made equal to the weight of the tool to ensure proper operation in all wellbore sizes. On the other hand, in a different wellbore size, the force exerted by the centralizer may be excessive, causing extra frictional drag that impairs the motion of the tools along the well. This situation has led to the development of constant force centralizers, which have been previously disclosed and are commercially available. The present invention, however, presents a new approach to constructing such a constant force centralizer.

Similar to centralizers, calipers extend arms or linkages from the tool body toward the wellbore wall. One difference between centralizers and calipers is that the arms of a caliper may be individually activated and may not open the same amount. Another difference is that caliper arms are usually selectively opened and closed into the tool body by some mechanical means. Thus, the arms of a caliper do not necessarily remain in contact with the wellbore wall at all times.

Various measuring instruments are often mounted on the caliper arms. In order to ensure the proper operation of some of these measuring instruments, it is often necessary to maintain a certain range of the magnitude of the radial force with which the caliper arms are pressed toward the wellbore wall. This requirement is sometimes difficult to achieve in horizontal sections of the well and variable wellbore sizes. The reason is that, like centralizers, the mechanical advantage of caliper linkages varies with wellbore size. Thus, the mechanical devices responsible for opening and closing the caliper must provide variable force output. This usually leads to poor efficiency of the mechanical device and its under-utilization in a large range of wellbore sizes. It is, therefore, beneficial to develop caliper linkage mechanisms that apply virtually constant radial forces given a constant mechanical input from the actuation device. The present invention provides such a mechanism.

Horizontal and highly deviated wells present yet another problem. Logging tools cannot be effectively conveyed into such wells by the force of gravity. This has led to the development of alternative conveyance methods. One such method is based on the use of a downhole tractor that pulls or pushes logging tools along the well.

Downhole tractors, such as those described in U.S. Pat. Nos. 5,954,131 and 6,179,055 B1, use various radially expandable mechanisms to force wheels or anchoring devices against the wellbore wall. Independent of the principle by which the motion with respect to the wellbore wall is achieved, the traction force that a tractor can generate is directly proportional to the radial force applied by the mechanism. Similar to centralizers and calipers, downhole tractors are designed to operate in a wide range of wellbore sizes. Like centralizers, they also have the problem of radial force variability as a function of wellbore size. Typically, for a given expansion mechanism, the traction force diminishes with wellbore size. It is advantageous if the radial force that a tractor generates is constant. However, no satisfactory solution to this problem has thusfar been disclosed.

Some tractors use several sets of different size linkages to provide a relatively constant traction force in a wide range of wellbore sizes. These mechanisms must, however, be replaced at the surface, which is very inconvenient. In addition, some wells are drilled with a variety of wellbore sizes that no single mechanism can handle. The present invention provides a mechanism that may be used with all known tractoring concepts to achieve a constant radial force and, therefore, consistent traction over a very wide range of wellbore sizes.

Centralizers, calipers, and tractors all rely on radially expandable mechanisms to perform their functions. These mechanisms may be either active or passive. The active mechanisms are powered by hydraulic or electric actuators. They are normally closed and are activated only during service. The passive mechanisms usually rely on springs to generate the outward radial force. While passive constant force mechanisms are commercially available, no active constant force mechanism has been disclosed. The present invention may be used either as a passive or an active mechanism that is capable of producing a substantially constant radial force.

The prior art that is relevant to the principle of operation of the invention discloses either the construction of constant force centralizers or the use of wedges in centralizing devices. For example, U.S. Pat. No. 4,615,386 discloses a centralizer that has approximately constant radial forces through a range of wellbore sizes. The constancy of the force is achieved by a combination of two springs with different characteristics. The sum of the two spring forces remains approximately constant over a wide range of movement of the centralizer arms. The advantage of this approach lies in its simplicity. The disadvantage is that it can only be used for centralizers, but not for calipers and anchoring devices that require selective opening and closing of the arms. Another disadvantage is that this operating principle requires the centralizer to be quite long, which may be undesirable in some instances. Similarly, U.S. Pat. Nos. 4,557,327 and 4,830,105 teach centralizing devices that achieve a virtually constant centralizing force by combining at least two springs of different kinds. The advantages and disadvantages of these devices are similar to those discussed above. U.S. Pat. No. 5,005,642 discloses a logging tool centralizer that achieves a lower degree of variability of the centralizing force by moving the attachment points of the centralizing arms at the opposite side of the tool body. Thus, the angle between the centralizer arm and the tool body can never become zero, which is the condition that makes inoperable most other centralizing devices that rely only on axial actuation. The disadvantage of this approach is that it does not solve the problem completely, as the radial force still varies with the wellbore size. It also makes construction of the device difficult, especially when it is desirable to use more than two centralizing arms.

In all patents discussed above, the radial expansion of the centralizer is achieved by a mechanism that consists of two arms that are joined together at one of their ends and are attached to moving hubs at their other ends. When the distance between the hubs changes, the attachment point of the two arms moves in or out in the radial direction. Another approach to achieving a radially expandable device is based on the use of tapered surfaces or wedges. Centralizers built on this principle are disclosed in U.S. Pat. Nos. 5,348,091 and 5,934,378. A radially expandable well drilling tool is disclosed in U.S. Pat. No. 4,693,328. The principle of radial expansion is again based on moving parts sliding over inclined surfaces (wedges). The advantage of this concept is that the forces generated can be substantial. A major disadvantage is the relatively limited range of radial expansion.

The present invention overcomes the disadvantages of both types of radially expandable mechanisms discussed above by kinematically combining these mechanisms into a single device that accomplishes new and novel results in a manner that is different from either of the devices.

BRIEF SUMMARY OF THE INVENTION

In one aspect of the present invention, a constant force actuator mechanism is provided that may be used with all known wellbore tractoring concepts to achieve a substantially constant radial force and, therefore, consistent traction in a very wide range of wellbore sizes.

In another aspect of the invention, a constant force actuator mechanism is provided that may be utilized either as a passive or as an active mechanism that is capable of producing a substantially constant radial force for application to opposed surfaces.

In a further aspect of the present invention, a constant force actuator mechanism is provided that may be effectively utilized as the operational component of a centralizer, a caliper, an anchoring device, a lifting jack, or other force transmitting devices, and may be energized by springs, hydraulic motors, pneumatic motors, mechanical energizing devices, and the like.

Briefly, the present invention is a mechanism that uses a force applied in a first linear direction to lift or support a load, or transmit a force, in a second linear direction that is substantially perpendicular to the first linear direction. Devices and mechanisms constructed in accordance with the principles of the present invention are constructed in such manner that the force that is required to support the load is of practically constant magnitude and is independent of the position of the load in the second linear direction. In particular, the invention relates to logging tools or other devices for wells that are conveyed along the inside surfaces of a wellbore or a pipe, or between spaced surfaces. The invention can conveniently take the form of a centralizer, a caliper, an anchoring device, or a tractor mechanism for use in wells, or may take the form of a lifting or load supporting device when embodied in jacks and other lifting or load supporting devices. The function of the present invention is to apply or react radial forces against the internal cylindrical wall of a wellbore or circular conduit, such as a pipe, for centralizing objects within the wellbore or pipe, to provide an anchoring function, or to provide mechanical resistance enabling the efficient operation of internal traction devices for conveying objects such as logging tools. When used as a centralizer for logging tools, a plurality of radially movable actuating linkages embodying the present invention maintain the logging tools at the center of the wellbore and thus enhance the accuracy of the logging process. When used as a caliper, the invention extends arms or other linkages toward the wellbore wall and exerts a controlled radial force on the wall surface. When used as an anchoring device, the invention can apply or react radial forces that generate enough friction against a wellbore or pipe wall to prevent any sliding at the points of contact between the anchoring device and the wall surface of the wellbore or pipe. The latter is needed for the construction and operation of downhole tractor tools, which are often used to convey other tools along wells that have horizontal or highly deviated sections. A major advantage of the present invention is that the magnitudes of the radial forces that it applies to the wellbore wall are virtually constant and independent of the wellbore size.

The main elements of the invention are force transmitting members or hubs, wheels, axles, and at least a pair of linkage arms with built-in wedges or with guide surfaces of predetermined geometry defined by the linkage arms. For purposes of the present invention the terms "force transmitting members" or "hubs" are each intended to mean members of any desired configuration, that are relatively linearly movable, with one or both of the members movable and, if desired, one of the members stationary. The linkage arms, the force transmitting members or hubs, and the wheels are joined by the axles to form a linkage that can expand or contract radially as the distance between the hubs changes in the axial direction. The linkage arms are joined together by a pivot member or axle at one of their ends, which allows only angular motion of the linkage arms to occur. At their second ends, the linkage arms are attached to separate hubs by axles or pivots that can both rotate and slide within an elongate slot in the hub body. The wheels or rollers, which define movement control elements, are rotatably mounted onto the hubs and, when in contact with the guide surfaces of the linkage arms, roll on the force transmitting guide surfaces of wedges or guide surfaces that are built into the linkage arms, formed on the linkage arms, or attached to the linkage arms. Although wheels or rollers are shown as force transmitting elements of the hubs or force transmitting members, structures other than wheels or rollers may be employed within the spirit and scope of the present invention to transmit forces from the hubs to the guide surfaces of the wedges or linkage arms. The force transmitting guide surfaces are of predetermined geometry so as to react with the force transmitting surfaces of the wheels or rollers and develop resultant force vectors on the linkage arms that are angulated with respect to the direction of linear motion of one or both of the hubs. These angulated force vectors cause pivotal movement of the linkage arms even when the linkages are fully retracted. This feature permits ease of starting motion of the linkages from their retracted positions.

The invention combines two separate principles to generate the required radial expansion. At small angles between the arms and the hubs, the radial force is created by the wheels, which roll on the force transmitting surfaces of the wedges or linkage arms. At larger angles, the expansion movement of the linkages is created on the principle of a triangular three-bar linkage. A transition between the two principles occurs at a pre-selected intermediate angle of the linkage arms between the fully retracted and fully extended positions. By combining these two principles and by the selection, placement and shape of the force transmitting guide surfaces of the wedge members it is possible to achieve substantially constant input axial force, which is the major advantage of the present invention and which is distinct as compared with other similar devices.

BRIEF DESCRIPTION OF THE DRAWINGS

The invention may be understood by reference to the following description taken in conjunction with the accompanying drawings in which.

DETAILED DESCRIPTION OF THE INVENTION

Illustrative embodiments of the invention are described below. It will be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time consuming but would nevertheless be a routine undertaking for those of ordinary skill in the art having the benefit of this disclosure.

Figure 1A:
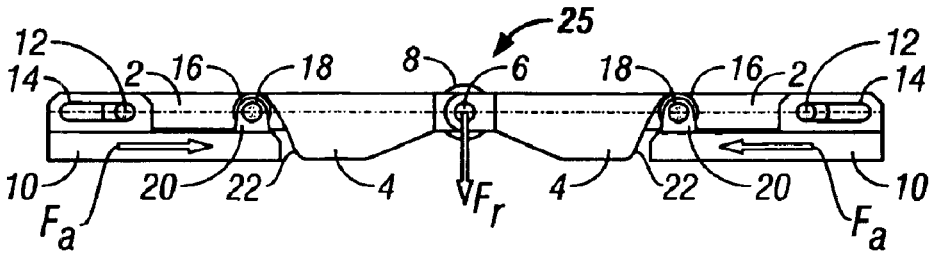
FIGS. 1A–1F are elevation views of a first illustrative embodiment of a constant force actuator according to the invention showing various positions of the constant force actuator from a closed or retracted position, shown in FIG. 1A, to a completely open or extended position shown in FIG. 1F.
Figure 1B:
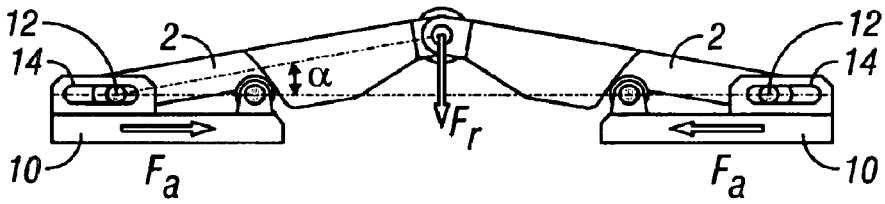
Figure 1C:
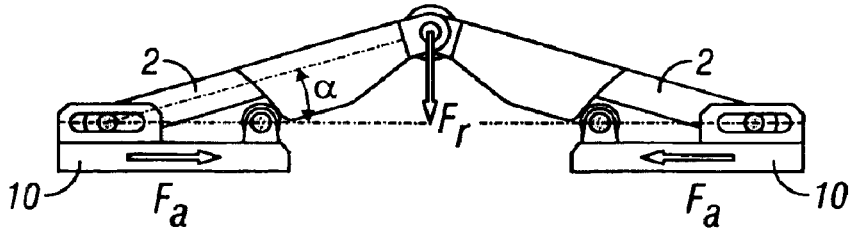
Figure 1D:
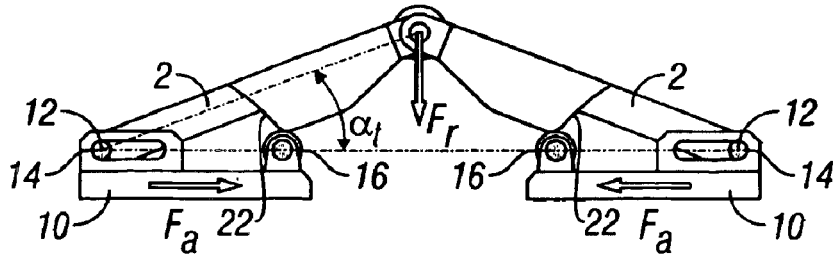
Figure 1E:
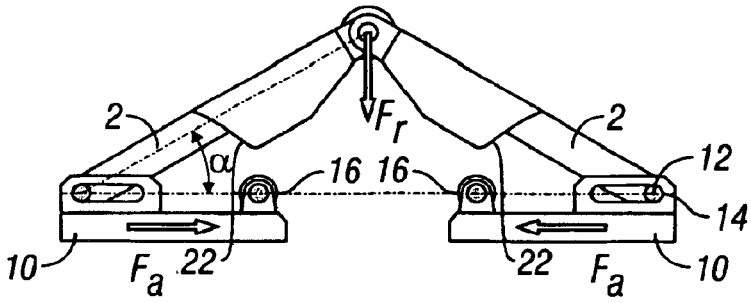
Figure 1F:
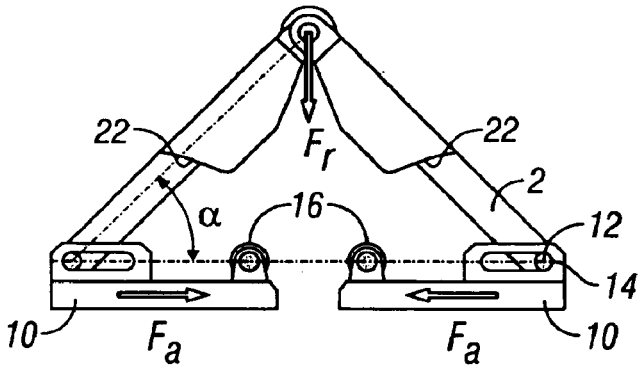

Referring now to FIGS. 1A–1F, the basic principles of the present invention are shown by way of operational illustrations, with the substantially constant force linkage of the apparatus being shown in its closed or fully retracted condition in FIG. 1A and at various stages of movement to a fully open or fully extended condition shown in FIG. 1F. The major elements and the principle of operation of the invention are schematically illustrated in FIGS. 1A–1F. Two linkage arms 2, with wedges 4 that are integral parts of the linkage arms, are joined together at their first ends by an axle or pivot 6. The axle 6 may also join other elements to the linkage arms depending on the desired function of the device constructed. For illustration purposes, FIGS. 1A–1F show a wheel or roller 8 also mounted onto axle 6, which implies that in this case, the invention would be used as a centralizer with the wheels 8 disposed for contact with opposed surfaces or for contact with opposite walls of a wellbore. The second ends of the linkage arms 2 are attached to hubs 10 with pivot pins 12, which slide and rotate inside elongate slots 14 in the hubs 10. Wheels 16 are mounted with axles 18 into brackets 20, which are parts of hubs 10. The function of the wheels 16 is to roll on the guide surfaces 22 of the wedges 4 and to react with the guide surfaces 22 to impart vectored forces to the linkage arms 2 and achieve linkage arm movement. The hubs 10 are restricted to move only linearly with respect to each other by other force transmitting elements or devices (not shown in FIGS. 1A–1F). All of these elements of the invention are combined to form a linkage, designated by the numeral 25.

FIGS. 1A–1F show the position of linkage 25 at various degrees of radial expansion. FIG. 1A shows linkage 25 in its closed or fully retracted position, when the angle between the arms and the hubs is zero (the angle being designated by the letter $\alpha$ in FIGS. 1B–1F). Note that in this position, wheels 16 contact the wedge surfaces 22 close to their top ends. Also note, that the pivot pins 12 are at the front ends of their respective elongate slots 14.

Now, imagine that the hubs 10 are displaced towards each other by axial forces designated by $F_a$ in FIGS. 1A–1F. This causes the wheels 16 to roll downwards on the guide surfaces 22 of the wedges 4, thus developing a force having a vector that is oriented for pushing the linkage arms upward, rotating them about their pivot pins 12. The arms 2 slide and pivot at their second ends during linkage movement, which leads to the configuration shown in FIG. 1B. Note that the angle $\alpha$ between the arms 2 and the straight line connecting the hubs 10 increases from its zero value in FIG. 1A to some positive value in FIG. 1B. In this situation, pins 12 are in some intermediate position in the elongate slots 14. The pivot pins 12 are free to move axially, and thus cannot support any axial load. However, they prevent the second ends of the linkage arms 2 from moving in the radial direction. All of these interactions force the first ends of the linkage arms 2 and the wheel 8 to move outwardly in the radial direction for radial extension of the linkage 25. When the wheel 8 comes into contact with the wellbore wall, it begins to exert radial force on it, moving the hubs 10, away from the wall and toward the center of the wellbore, thus creating a centralizing effect.

Further radial expansion of linkage 25 based on the rolling of wheels 16 on guide surfaces 22 is shown in FIGS. 1C and 1D. As seen in these Figures, angle $\alpha$ continues to increase and wheel 8 continues to move out in the radial direction. FIGS. 1A–1D illustrate the first kinematic principle used in the invention, which is based on the interaction between the guide surfaces 22 of the wedges 4 and the force transmitting wheels or rollers 16. Note that in FIG. 1D, the wheels 16 have reached the very bottom end of the wedge surfaces 22. This situation indicates that the amount of radial expansion based on this first kinematic principle has already been exhausted. Also note that the pivot pins 12 have reached the rear ends of the elongate slots 14. This position of pins 12 and wheels 16 is the transitional point between the two kinematic principles used in the invention. For this reason, the linkage arm angle in FIG. 1D is designated by $\alpha_t$ (transition). At angles smaller than $\alpha_t$, the radial expansion of the linkage is caused by the wedges, while at angles larger than $\alpha_t$, the radial expansion of the linkage is caused by the equivalent of a three-bar mechanism.

The second kinematic principle on which the invention is based is illustrated in FIGS. 1D–1F. The two linkage arms 2 and the hubs 10 form a triangular three-bar mechanism with the hubs 10 representing a bar with variable length. As the distance between the hubs 10 decreases, the triangle changes shape with its tip moving further outward in the radial direction. Note that the wedges 4 do not take any part in this motion, because, as shown in FIGS. 1E and 1F, the guide surfaces 22 of the wedges 4 have lifted off wheels or rollers 16.

Figure 2:
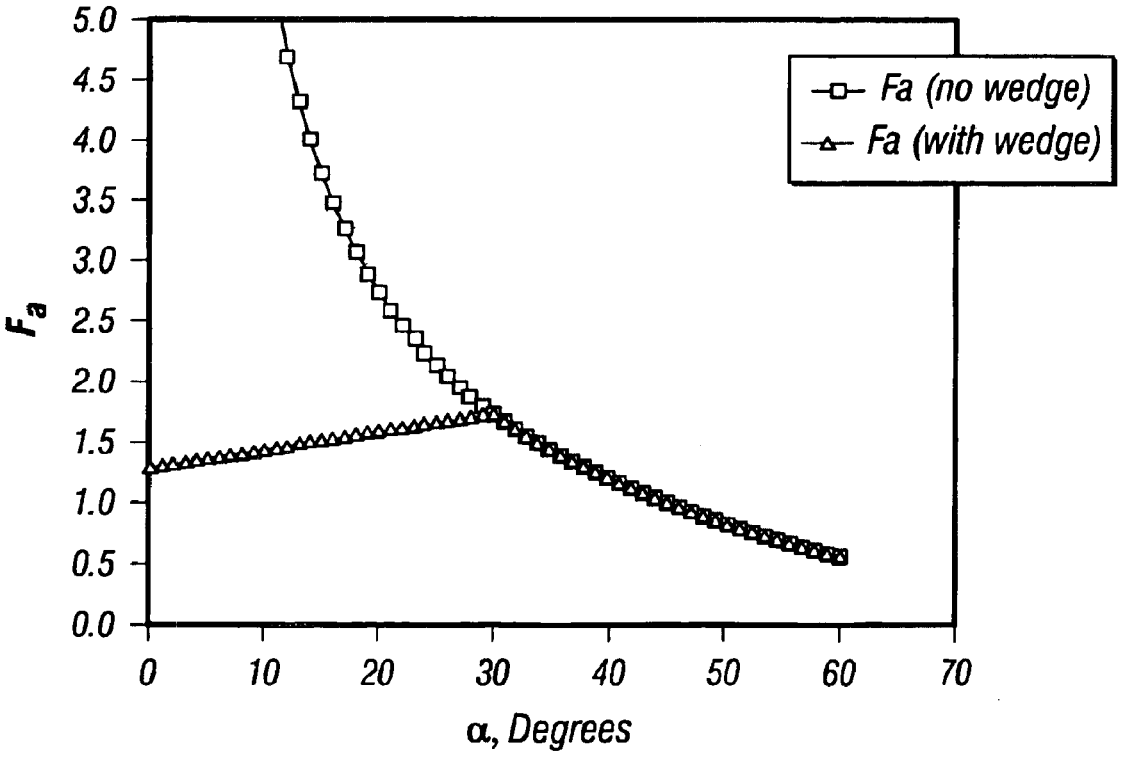
FIG. 2 is a force versus movement diagram illustrating the axial force required for support of a radial load and illustrating small angle linkage movement with the wedge of the actuator and larger angle linkage movement after the linkage has separated from the force transmitting surface of the wedge.

Now imagine that a downward radial force $F_r$ has acted through the whole expansion process. Also imagine that the magnitude of the axial force $F_a$ that is necessary to overcome $F_r$ and to continue the expansion has been recorded and represented graphically. An illustration of such a graphical representation is shown in FIG. 2. The exact magnitudes of the numbers and the shapes of the curves represented in FIG. 2 will vary depending on the location of the wedge 4 on the linkage arms 2 and the radius of curvature of the wedge guide surface 22. However, FIG. 2 is a sufficient illustration of the advantage of combining two separate kinematics principles in one mechanism. In FIG. 2, the curve indicated by $F_a$ (no wedge) illustrates the magnitude of the axial force $F_a$ that would be required to overcome $F_r$ if only the second kinematic principle of the three-bar linkage were used. As seen from the chart of FIG. 2, in this case $F_a$ rises sharply at small values of $\alpha$. This means that the three-bar linkage, on which many existing devices are based, has real difficulties in supporting radial loads at small angles. In fact, at $\alpha$ equal to zero, the axial force required to support the load would be infinitely large, which means that no practical device can be constructed to operate in this range. The second curve on the chart of FIG. 2 represents possible values of $F_a$ if two kinematic principles are combined, as suggested in the present invention. It can be seen that the sharp increase of $F_a$ at small angles $\alpha$ is avoided and that $F_a$ remains fairly constant within a large range of values of the angle $\alpha$. It should be noted that FIG. 2 is by no means exhaustive of the possible values of $F_a$ that can he achieved by the present invention. As indicated earlier, by varying the location of the wedge 4 on the arm 2 and by varying the radius of curvature of the wedge 4 and the geometry of the guide surface 22, it is possible to achieve almost any shape of curve dependent on the function demanded from the particular embodiment of the invention.

Figure 3:
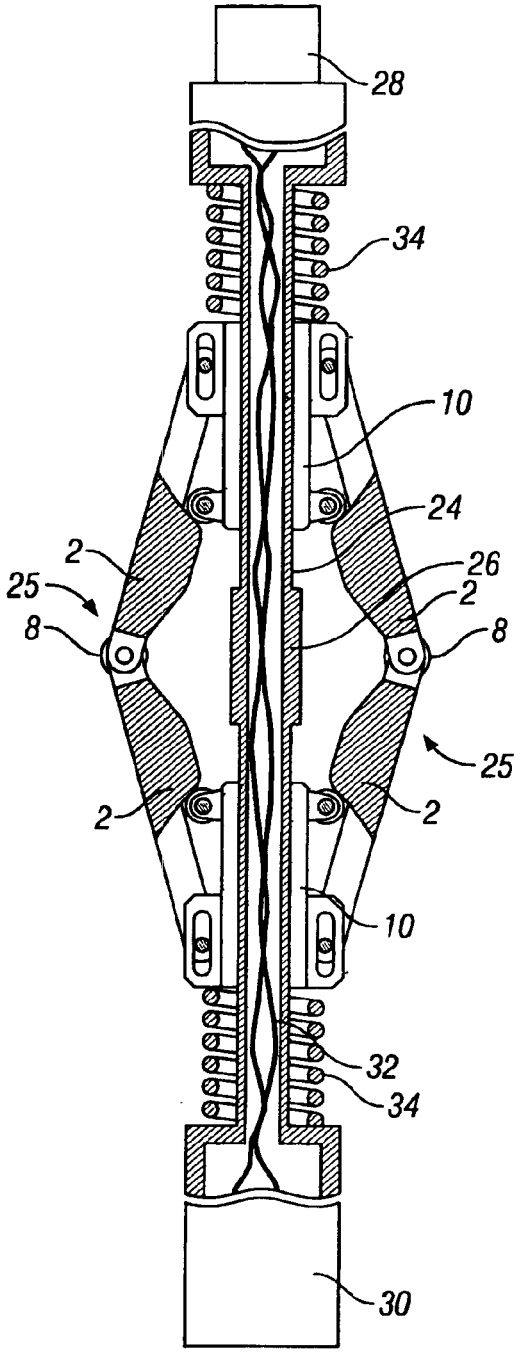
FIG. 3 is a sectional view of a spring urged centralizer embodiment of the present invention applicable for use in wells and for other centralizing applications and incorporating symmetrical opposed linkages with roller engaging wedges on all linkage arms.

Various embodiments of the invention are discussed in more detail in FIGS. 3–12. FIG. 3 represents one embodiment of the invention as a tool centralizer. A minimum of three linkages 25 (only two opposing linkages are shown in FIG. 3) are combined together by common hubs 10. The hubs 10 slide on a mandrel 24. Integral with the mandrel 24 is a hub stop 26, which limits the linear motion of the hubs 10 on the mandrel 24. The mandrel 24 is also connected to upper head 28 and lower head 30, which are used to connect the centralizer to other tools and devices in the tool string (the details of the connections to other tools are not essential for the present invention and are not shown in FIG. 3). The mandrel 24 may also have wires 32 going through it for electrical communication with other tools in the tool string. The axial force that causes the centralizer to expand radially and to position the other tools in the tool string at the center of the wellbore is provided by springs 34. As seen from the embodiment of the invention shown in FIG. 3, only one type of spring is necessary for the construction of a centralizer with a relatively constant centralizing force.

Figure 4:
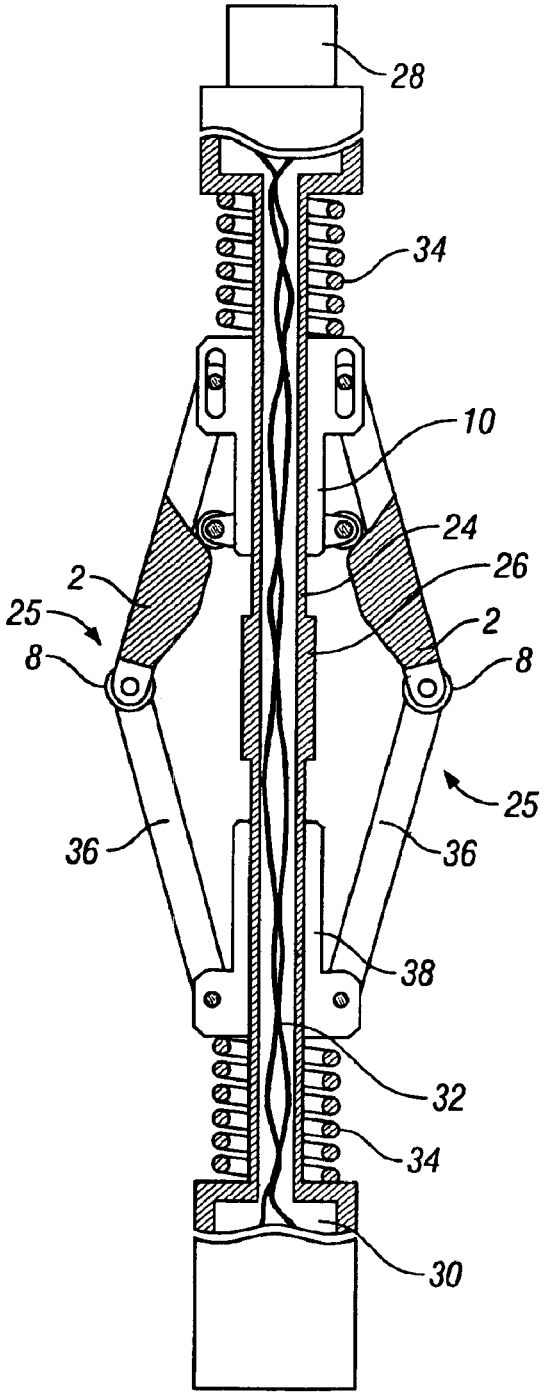
FIG. 4 is a sectional view of a spring urged centralizer embodiment of the present invention having asymmetric linkages having wheel or roller engaging wedges only on upper linkage arm sections.
Figure 5:
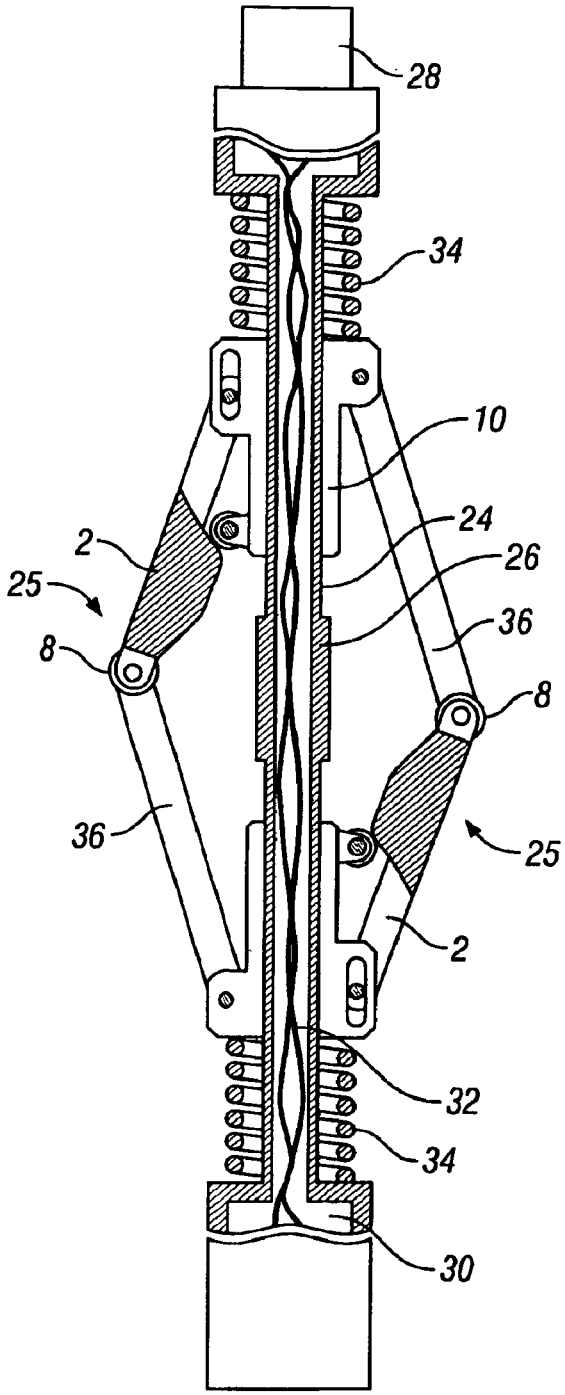
FIG. 5 is a sectional view of a spring urged centralizer embodiment having asymmetric linkages oppositely arranged.

The linkage 25 used for the construction of various devices does not need to be symmetric. Two devices that are constructed with asymmetric linkages, which still operate on the principles disclosed above, are shown in FIGS. 4 and 5. In these figures only one of the arms that are used to build the linkage has a wedge. Alternatively, wedges with guide surfaces of different geometry could be put on arms that have unequal lengths.

All embodiments of the invention discussed above represent tool string centralizers. Constant force centralizers can be achieved by means other than those discussed above. The present invention represents a new method by which such centralizers can be constructed.

Figure 6:
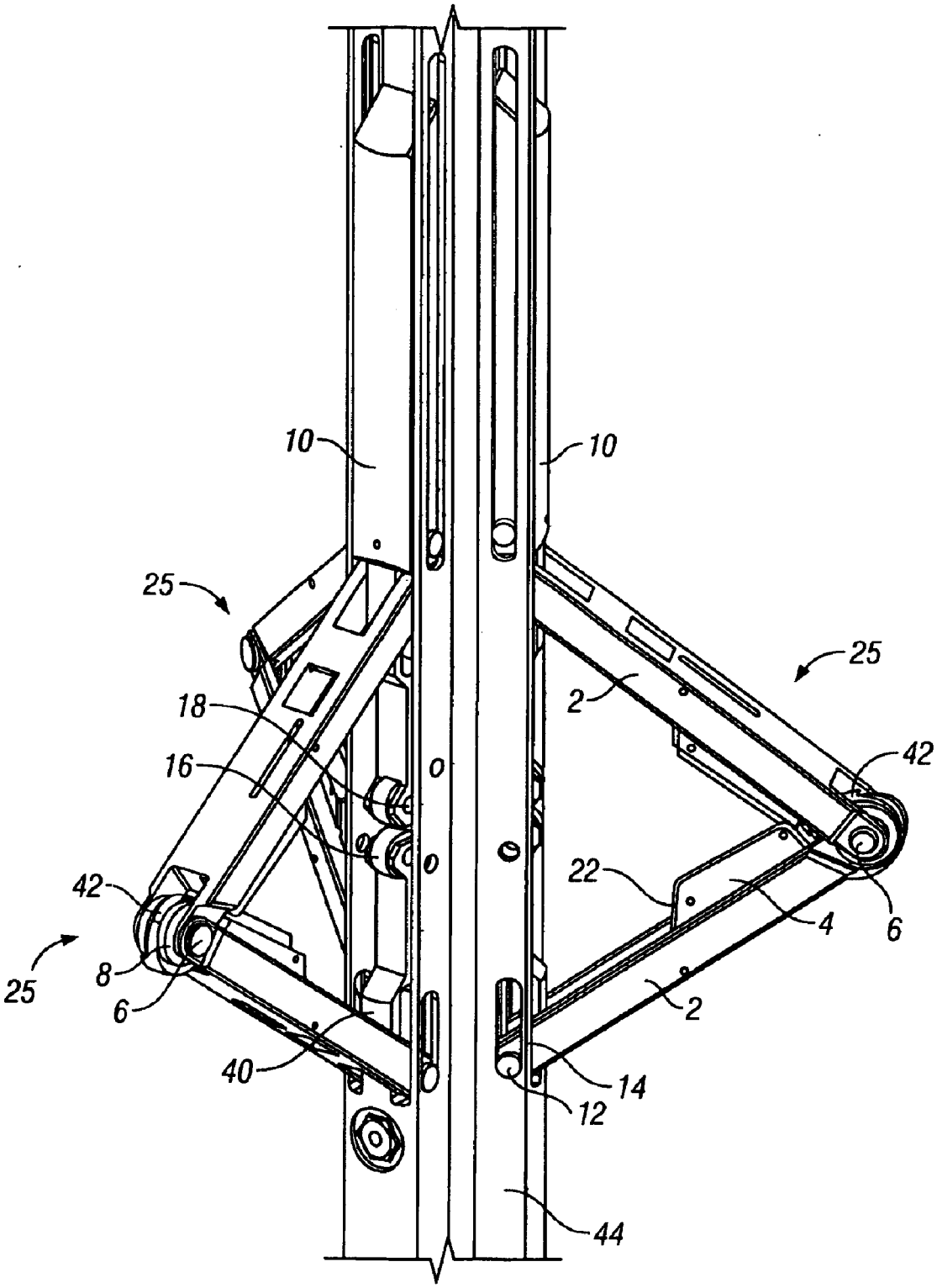
FIG. 6 is an isometric illustration showing an embodiment of the present invention as a downhole tractor tool grip.

The advantages of the invention, however, are far greater in devices that have the ability to selectively open and close their linkages in and out of the tool body. The reason is that such "active" devices usually have only axial linear actuators available for opening and closing the linkages into the tool as opposed to elements used in centralizers, which have a radial force component. Examples of devices that require selective opening and closing of linkages are calipers and downhole tractor tools. An embodiment of the invention used as a grip in a downhole tractor tool is shown in FIGS. 6 and 7A–7C. FIG. 6 is a three dimensional view of a tractor tool grip, which is constructed using the constant force actuator principles discussed above. The tractor tool grip has two main functions. The first is to selectively open and close the linkages and centralize the tool in the wellbore when necessary. In this respect, the tractor grip is not much different from the centralizers shown in FIGS. 3–5. The difference is that the grip is not continuously open and that it is powered by hydraulic or electromechanical actuators, which allow the selective opening or closing. The second function of the tractor grip is to selectively anchor the tool with respect to the well wall. In the embodiment shown in FIG. 6, this is achieved by the installation of cams 42 at the tips of linkages 25 and a device for selectively locking the geometry of the linkage (not shown in FIG. 6). The principle on which the cams 42 selectively anchor the tool with respect to the well wall and the physics of tractoring have been disclosed in U.S. Pat. Nos. 5,954,131 and 6,179,055, and in co-pending U.S. patent application Ser. No. 09/921,825, incorporated herein by reference. Since these are not essential for the operation of the proposed invention they are not discussed here in detail.

As seen in FIG. 6, the tractor grip consists of three symmetrical linkages 25. Similar to the description provided with regard to FIG. 1, each linkage consists of two arms 2, which are joined together at their first ends by an axle 6. The axle 6 also joins other elements of the grip such as the wheels 8 and the bi-directional cam 42, which is responsible for the tractoring action. The three upper arms 2 in FIG. 6 are attached to hub 10 which can slide with respect to the grip body 44. This is also similar to the description given in FIG. 1. However, the three bottom arms 2 are not attached to a moving hub, but are instead mounted onto a stationary hub 40, which is an integral part of the grip body 44. This demonstrates the flexibility of the invention. As explained earlier, the only requirement for the invention to work is that the hubs 10 can move with respect to each other in the axial direction. It is not necessary, however, that both hubs can move with respect to the tool body. FIG. 6 also shows other elements of the invention such as wedges 4, wedge guide surfaces 22, wheels 16, pivot pins 12, and slots 14. Note that the grip in FIG. 6 is shown in its fully opened or extended state. The moving hub 10 and the stationary hub 40 are touching, which is seen from the proximity of the wheels 16. Also note that the pins 12 are at the bottom end of slots 14, which indicates that the second kinematic principle of the invention is active. FIG. 6 also shows that the wedge guide surface 22 can also be made flat (infinite radius of curvature) to achieve the desired force characteristics.

The basic elements of the invention, shown in FIG. 6 can be combined with other linkages to construct more complex mechanisms. While the invention has been described with respect only to its basic set of elements, those skilled in the art, having benefit of this disclosure, will appreciate that other embodiments can be devised which do not depart from the scope of the invention as disclosed herein.

Figures 7A, 7B, 7C:
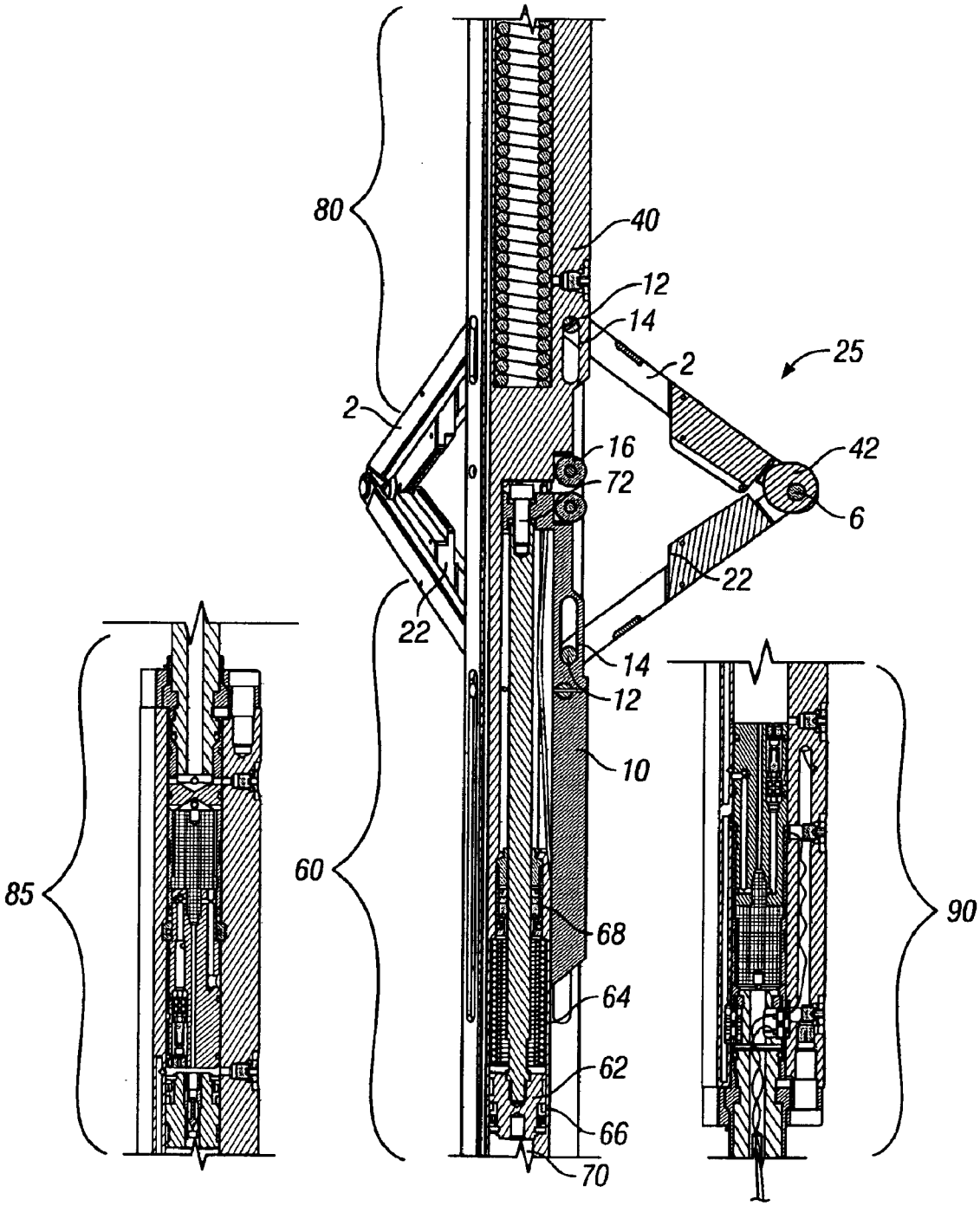
FIG. 7A is a sectional view of the upper portion of a downhole tractor tool grip embodying the principles of the present invention.
FIG. 7B is a sectional view of the intermediate portion of the downhole tractor tool grip of FIG. 7A.
FIG. 7C is a sectional view of the lower portion of the downhole tractor tool grip of FIGS. 7A and 7B.

FIGS. 7A–7C are cross sectional views of the downhole tractor grip embodiment shown in FIG. 6. FIG. 7B is a continuation of FIG. 7A, and FIG. 7C is a continuation of FIG. 7B. The linkages 25 of the tractor grip shown in FIGS. 7A–7C are shown in their fully open position. Note that wheels 16 are away from the wedge guide surfaces 22. In addition to the elements of the embodiment discussed earlier, FIG. 7B also shows the actuator 60 that provides the axial force necessary for the selective opening and closing of the linkages 25 in and out of the tool body, as well as parts of the hydraulic control circuits necessary for the operation of the grip. In this particular embodiment, the axial force is generated by a hydraulic actuator 60, which consists of piston 62, spring 64, and dynamic seals 66 and 68. The piston 62 of the actuator 60 can move up or down as chamber 70 is connected to or disconnected from a source of high pressure hydraulic fluid (not shown in FIGS. 7A–7C). Piston 62 is attached to the moving hub 10 with a screw 72 and thus, the motion of the actuator forces hub 10 to move with respect to hub 40. Other elements of the embodiment shown in FIGS. 7A–7C are a high pressure accumulator, designated with the general numeral 80, and the two hydraulic cartridges 85 and 90, which control the opening and closing of linkages 25 and control the tractioning process. Since the high pressure accumulator 80 and the hydraulic cartridges 85 and 90 are peripheral to the operation of the invention, and since they have been disclosed in co-pending U.S. patent application Ser. No. 09/921,825, they are not discussed in detail here. All other elements of the invention shown in FIGS. 7A–7C have the same numerical designations and the same functions as those discussed with regard to previous figures.

Those skilled in the art will appreciate that traction mechanisms other than cams can be combined with the invention. Thus, the invention can improve the operation of virtually every downhole tractor tool, independent of the principle upon which the traction of the tractor is generated. Examples of the usage of different traction devices in conjunction with the invention are schematically shown in FIGS. 8, 9, and 10.

Figure 8:
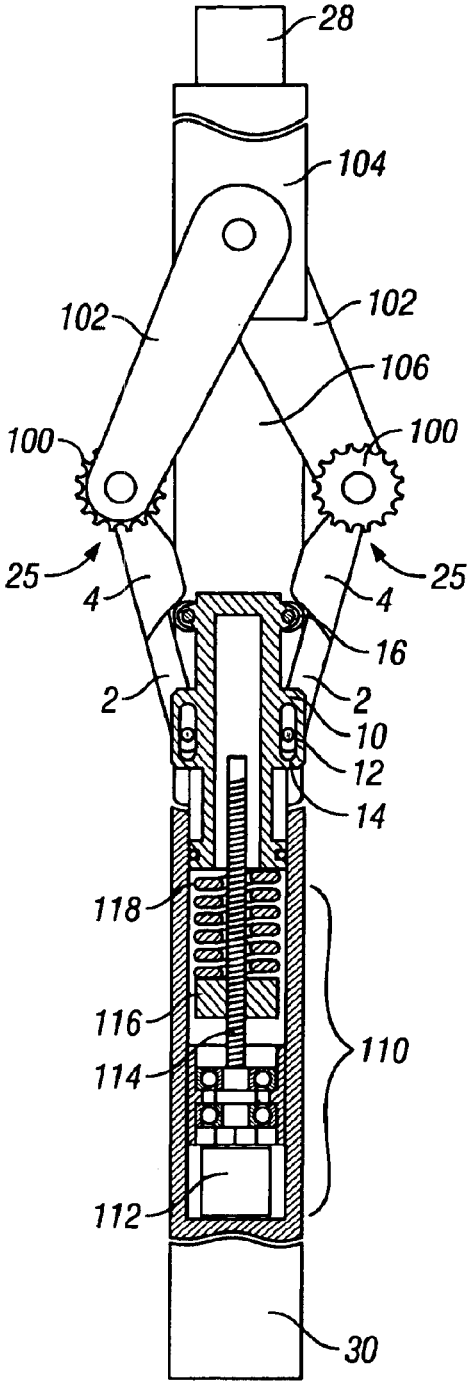
FIG. 8 is a sectional view of a downhole tractor mechanism embodying the principles of the present invention and including powered tractor wheels for driving engagement with opposed surfaces or opposite sides of a wellbore.

FIG. 8 represents a downhole tractor tool in which the traction is generated by powered drive wheels 100 mounted at the tips of linkages 25. Similar to the asymmetric linkage design shown in FIG. 4, the tractor tool shown in FIG. 8 has arms 2 equipped with wedges 4 only on the bottom side of each linkage 25. The two top arms 102 can only pivot with respect to the stationary hub 104, which is an integral part of the tool body 106. Arms 102 also house drive trains (not shown), which transmit rotary motion from a motor (not shown) inside the tool body 106 to the drive wheels 100. The moving hub 10, arms 2, wedges 4, wheels 16, pins 12, and slots 14 all function as described in connection with FIG. 1. FIG. 8 also shows schematically one type of actuator 110 that can be used to selectively open and close linkages 25. In this embodiment, the actuator 110 consists of a motor 112, which drives a ball screw 114. As the ball screw 114 turns, a ball nut 116 travels up or down. The ball nut 116 transmits its linear motion to the hub 10 through a spring 118, which provides the flexibility of linkages 25 necessary when the tractor tool encounters small variations in wellbore size or other obstacles.

Figure 9:
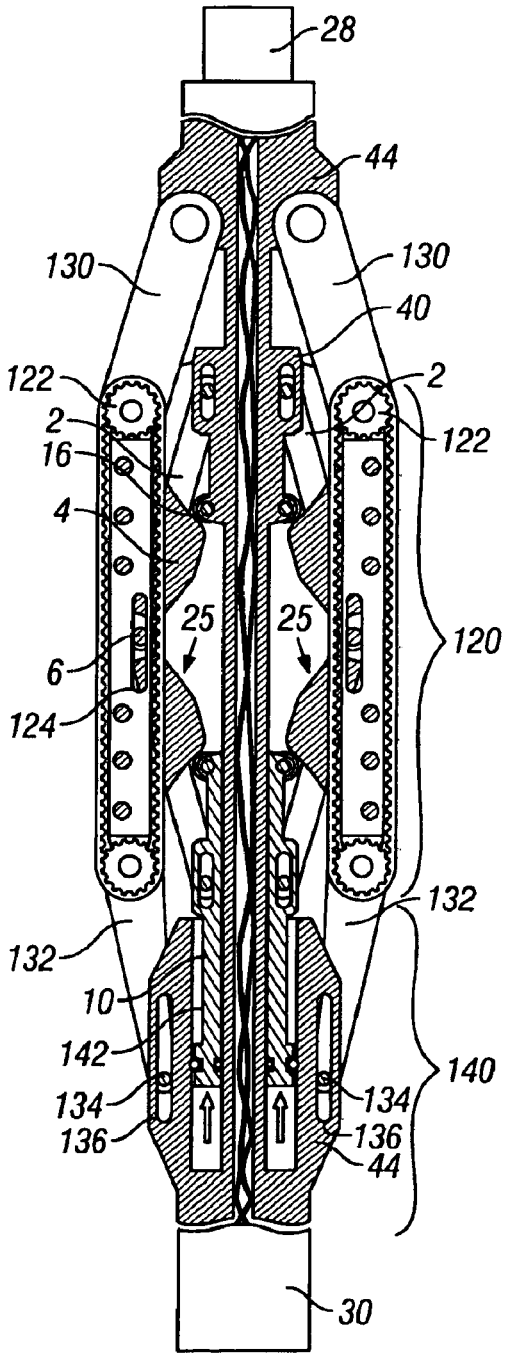
FIG. 9 is a sectional view of a downhole tractor mechanism constructed according to the present invention and including powered tracks for driving engagement with opposed surfaces or with opposite sides of a wellbore.

FIG. 9 is a schematic representation of another traction mechanism that can be used with the invention. In this case, tracks 120 are mounted at the tips of symmetric linkages 25. The tracks are attached to linkages 25 with pivot pins 6 that can slide and pivot in slots 124 in the tracks 120. At their upper ends the tracks 120 are attached to arms 130 which, similar to arms 102 in FIG. 8, house mechanical elements (not shown) for transmitting rotary motion from a motor (not shown) in the tool body 44 to the drive sprockets 122 of the tracks 120. At their lower ends tracks 120 are attached to another set of arms 132, which enable the tractor tool to go through changes in wellbore size and other obstacles. Arms 132 are attached to the tool body 44 with pins 134 that slide in slots 136. FIG. 9 also shows a moving hub 10 and a stationary hub 40, which have exactly the same functions as those described in connection with FIG. 6. The actuator 140, shown in FIG. 9, operates on a different principle from the actuator 110 shown in FIG. 8. The actuator 140 consists of a hydraulic piston 142, which is an integral part of the moving hub 10. This illustrates the flexibility of the invention and the fact that it will work with a variety of actuators that operate on different principles. The type of actuator used does not affect how the invention achieves its expansion.

Figure 10:
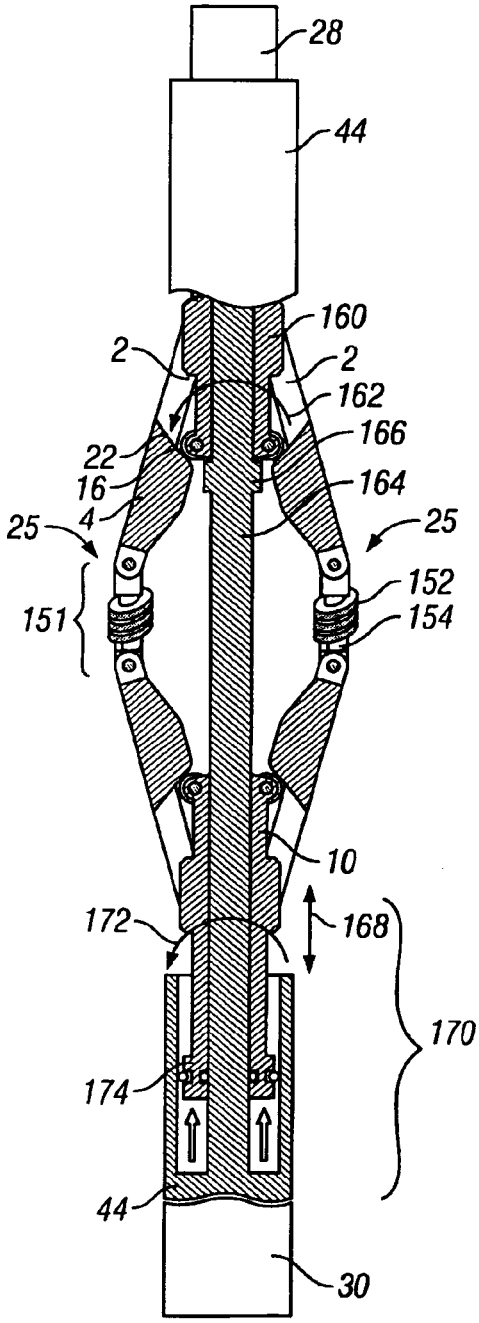
FIG. 10 is a sectional view of a downhole tractor mechanism constructed according to the present invention and having rollers and rotating hubs for driving engagement with opposed surfaces or with opposite sides of a wellbore.

FIG. 10 is a schematic illustration of yet another embodiment of the present invention having the form of a downhole traction system. In this case, roller assemblies 151 that consist of rollers 152 are mounted on inclined axles 154 at the tips of linkages 25. Traction is achieved by rotating the moving hub 10 and the stationary hub 160 with respect to a central mandrel 164 of the tool body 44. The direction of rotation is indicated by the rotational movement arrow 162 in FIG. 10. As the whole set of linkages 25 rotates, the tractor tool achieves a corkscrew motion along the internal wall of a wellbore. The rotary motion of the tractor mechanism is generated by a motor and a gear train (not shown) that are inside the tool body 44. The rotary motion is then transmitted to hub 160. Note that hub 160 is only free to rotate with respect to the central mandrel 164 but is prevented from sliding with respect to the tool body 44 by a ledge 166, which is defined by an enlarged section of the central mandrel 164. The other hub 10 can both rotate and translate with respect to the central mandrel 164 as indicated by arrows 172 and 168. When hub 10 slides up or down on the central mandrel 164, linkages 25 expand or contract radially. Similar to the embodiments discussed earlier, the translation of hub 10 up or down is achieved by a linear actuator, designated by the numeral 170. In FIG. 10, the actuator is shown as a hydraulic piston 174 that is an integral part of hub 10. As explained earlier, actuators operating in accordance with other principles can also be constructed without departing from the spirit and scope of the present invention.

Figure 11:
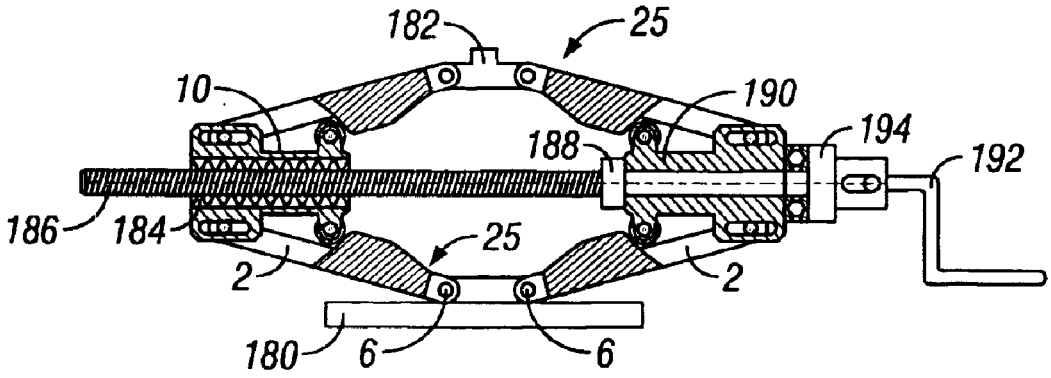
FIG. 11 is a sectional view showing an object raising and lowering jack mechanism embodying the principles of the present invention and having manual actuation of opposed linkages by a rotary jack screw.
Figure 12:
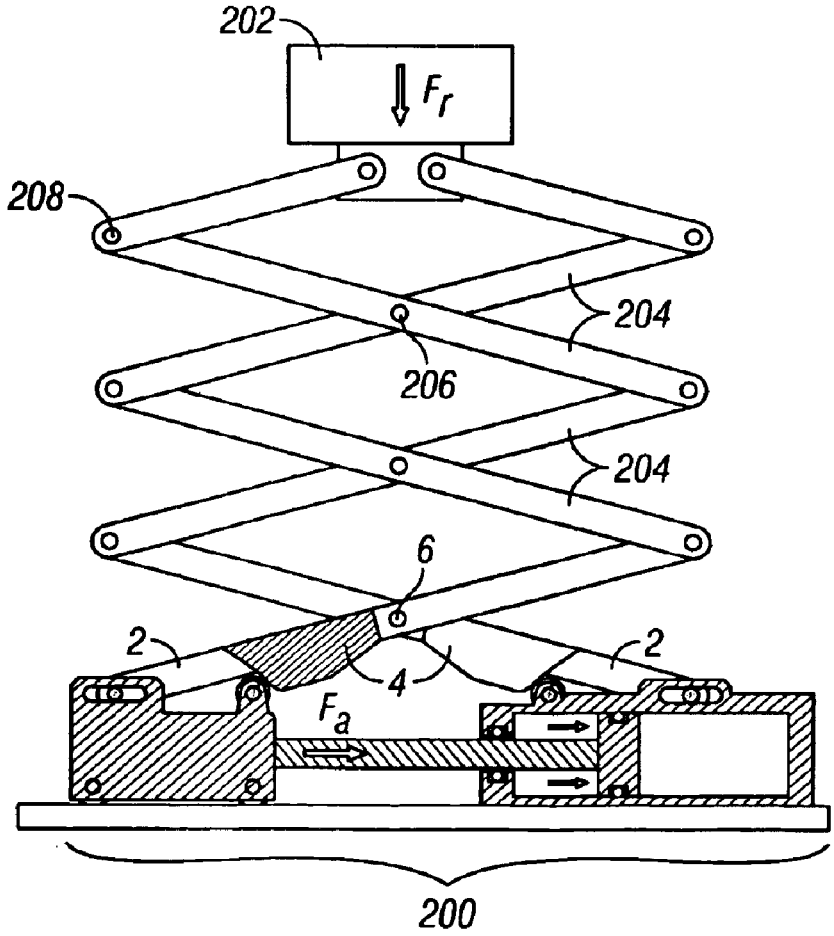
FIG. 12 is a partial sectional and partial elevation view illustrating a load lifting scissors mechanism having a set of scissors arms defining interacting linkages with wedges and force transmitting rollers for substantially constant force scissors actuation.

In all the embodiments discussed so far, the invention was combined with other mechanisms to construct various downhole tools to be operated in wells and pipelines. However, the invention is not limited to these embodiments. In general, the invention can improve the operation of any device that is designed to support a load in one direction by the application of a force in a second direction perpendicular to the first direction. Two such embodiments are shown in FIGS. 11 and 12. FIG. 11 illustrates an embodiment of the present invention which functions as a load lifting jack device, such as a jack for raising and lowering an automotive vehicle. In FIG. 11, one symmetric linkage 25 is attached to a base 180, while another linkage 25 is attached to the lifting fixture 182. The two force transmitting members or hubs 10 and 190 function exactly as described in connection with FIG. 1 as they move with respect to one another in the axial direction. The axial actuator in this case is a screw-nut mechanism, with a driven nut 184 being a part of hub 10. The screw 186 is threaded into nut 184 and can be rotated with respect to hub 190 with a crank handle 192. The linear motion of screw 186 with respect to hub 190 is prevented by the stop 188 and the bearing assembly 194. Most existing car jacks that use triangular kinematic mechanisms are very difficult to start when they are fully contracted. The present invention overcomes this problem. As explained with regard to FIGS. 1 and 2, the axial force that the invention requires is substantially constant. Thus, the rotational force that must be applied to the crank handle 192 in order to lift the load is also constant and thus the jack is easy to start from its contracted position.

Another embodiment of the invention that can be used to lift a load in one direction by the application of a force in a perpendicular direction is shown in FIG. 12. In FIG. 12, an actuator 200 that generates the force $F_a$ is used to lift the load 202, which exerts a downward force $F_r$. As seen in the figure, arm 2 can be extended beyond the location of the pivot or axle 6 that joins the two linkage arms 2 in pivotal assembly. This does not change the principle upon which the invention operates and again demonstrates the flexibility of the invention. The addition of extra linkages 204 joined at pins 206 and 208 does not change the principle of operation of the invention. Those skilled in the art will readily appreciate that a great variety of mechanisms and devices for a variety of industrial applications can be constructed within the scope of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

We claim:

1. A method for imparting a substantially constant force to an object, comprising:

positioning a constant force actuator adjacent the object, the constant force actuator having a pair of force transmitting members disposed for relative linear movement, at least one of said force transmitting members being linearly movable, and a linkage in force receiving relation with said force transmitting members and having a first force transmitting element movable by said linkage in a direction substantially perpendicular to said relative linear movement of said force transmitting members and disposed for force transmitting contact with an object, said linkage having a movement control guide of predetermined movement control geometry in force reacting engagement with at least one of said force transmitting members and translating said relative linear movement of said force transmitting members to expansion and contracting movement of said linkage and linear movement of said first force transmitting element, said method comprising:

initiating expansion movement of said constant force actuator by causing relative linear movement of said force transmitting members toward one another and causing reaction of said movement control geometry with at least one of said force transmitting members and developing a linkage movement force oriented for expansion movement of said linkage and developing a substantially constant linkage transmitting force on said first force transmitting element;

continuing expansion movement of said constant force actuator by continuing said relative linear movement of said force transmitting members until a predetermined intermediate angular relation of said linkage has been reached and said predetermined movement control geometry and said at least one force transmitting member have separated;

further continuing expansion movement of said constant force actuator by continuing said relative linear movement of said force transmitting members with said force transmitting members acting directly on said linkage until desired extension of said linkage and desired movement of said first force transmitting element have been achieved.

2. The method of claim 1, wherein said linkage is defined by a pair of linkage arms each having a first end thereof pivotally connected to one of said force transmitting members, at least one of said linkage arms having said movement control guide of predetermined geometry thereon, and a second force transmitting element is mounted on at least one of said force transmitting members for force transmitting engagement with said movement control guide, said method further comprising:

reacting said second force transmitting element with said movement control guide during said relative linear movement of said force transmitting members toward one another and developing a linkage movement force of angular direction with respect to said linear movement of said force transmitting members and causing extension movement of said linkage.

3. The method of claim 1, wherein said linkage is defined by a pair of linkage arms each having a first end thereof pivotally connected to one of said force transmitting members, at least one of said linkage arms having said movement control guide of predetermined geometry thereon, and a guide roller is mounted for rotation on at least one of said force transmitting members for force transmitting engagement with said movement control guide, said method further comprising:

during a first portion of said relative linear movement of said force transmitting members reacting said guide roller with said movement control guide during said relative linear movement of said force transmitting members toward one another and developing a linkage movement force having an angular direction with respect to said linear movement of said force transmitting members and causing expansion movement of said linkage; and during a second portion of said relative linear movement of said force transmitting members applying force from said force transmitting members directly to said linkage causing further expansion movement of said linkage.

4. The method of claim 1, wherein said linkage is defined by a plurality of pairs of linkage arms disposed for radial expansion and contraction movement relative to said force transmitting members, said method further comprising:

extending said plurality of pairs of linkage arms simultaneously and radially by relative linear movement of said force transmitting members and applying substantially constant force of each of said pairs of linkage arms to the object.

5. The method of claim 1, wherein pivots interconnect said linkage with said force transmitting members, said pivots being linearly and pivotally movable with respect to said force transmitting members, said method further comprising:

causing linear and pivotal movement of said pivots relative to said force transmitting members during relative linear movement of said force transmitting members during expansion and contraction movement of said linkage.

6. A method for imparting a substantially constant force to an object, comprising:

positioning a constant force actuator adjacent the object, the constant force actuator having first and second force transmitting members linearly movable relative to one another and having a movement control element located on at least one of said first and second force transmitting members, and further having a pair of linkage arms each having a first end pivotally connected to a respective one of said first and second force transmitting members and each having second ends pivotally interconnected and defining a pivotal linkage angularly movable from a retracted position to an extended force transmitting position, and a linkage arm movement control guide having a predetermined movement control geometry and having linkage moving engagement with said movement control element during a portion of the extension movement of said pivotal linkage from said retracted position to said extended position, said method comprising:

initiating extension movement of said constant force actuator from said contracted position of said pivotal linkage by moving at least a first of said force transmitting members linearly toward said second force transmitting member and causing reaction of said movement control element with said linkage arm movement control guide and developing a linkage movement force oriented for extension movement of said pivotal linkage and developing a substantially constant linkage transmitting force;

continuing extension movement of said constant force actuator by forcible interaction of said linkage arm movement control guide and said movement control element until a predetermined intermediate angular relation of said pivotal linkage has been reached and said linkage arm movement control guide and said movement control element have separated;

further continuing said extension movement of said constant force actuator by further moving said first and second force transmitting members toward one another and applying linear force from said force transmitting members directly to said pair of linkage arms; and from the extended condition of said constant force actuator causing contracting movement thereof by relative linear movement of said force transmitting members away from one another, said force transmitting members inducing contracting movement of said pivotal linkage.

7. A substantially constant force actuator, comprising:

a pair of force transmitting members disposed for relative linear movement; and a linkage in force receiving relation with said force transmitting members and having a force transmitting element movable by said linkage in a direction substantially perpendicular to said relative linear movement of said force transmitting members and disposed for force transmitting contact with an object, said linkage having at least one movement control guide of predetermined geometry in force reacting engagement with at least one of said force transmitting members and translating said relative linear movement of said force transmitting members to extension and contraction movement of said linkage and linear movement of said force transmitting element.

8. The substantially constant force actuator of claim 7, wherein:

said linkage comprises a pair of linkage arms each having pivotal connection with one of said force transmitting members and pivotally connected to one another;

said movement control guide is located on at least one of said linkage arms; and said force transmitting element is located on at least one of said linkage arms and is disposed for contact with the object to which force is to be transmitted.

9. The substantially constant force actuator of claim 7, wherein:

said linkage comprises a pair of linkage arms having a pivot establishing a pivotal connection of said linkage arms; and wherein said pivot establishes a pivotal connection of said force transmitting element with said linkage.

10. The substantially constant force actuator of claim 7, wherein:

said force transmitting members each define an elongate slot; and further comprising pivot members having pivotal movement and linear movement within said elongate slots and establishing movable connection of said linkage with said force transmitting members within said elongate slots.

11. The substantially constant force actuator of claim 7, wherein:

said linkage is defined by a plurality of opposed pairs of linkage arms arranged for extension and contraction movement within a wellbore for application of force to a wellbore wall and each of said plurality of pairs of linkage arms extends and contracts in response to relative linear movement of said force transmitting members;

said force transmitting members each define an elongate slot; and further comprising pivot members having pivotal movement and linear movement within said elongate slots and establishing movable connection of said linkage arms with said force transmitting members within said elongate slots.

12. The substantially constant force actuator of claim 7, further comprising:

at least one spring member imparting said relative linear movement to said force transmitting members in a first linear direction and being compressed by relative linear movement of said force transmitting members in a second linear direction opposite said first linear direction.

13. The substantially constant force actuator of claim 7, further comprising:

at least one hydraulic actuator in driving relation with at least one of said force transmitting members and imparting linear movement thereto for extension movement of said linkage.

14. The substantially constant force actuator of claim 7, further comprising:

a rotary motor driven actuator mechanism in linear driving relation with at least one of said force transmitting members and imparting linear movement thereto for extension and contraction movement of said linkage.

15. The substantially constant force actuator of claim 7, further comprising:

a mechanical actuator in linear driving relation with at least one of said force transmitting members and imparting linear movement thereto for extension and contraction movement of said linkage.

16. The substantially constant force actuator of claim 7, wherein:

said linkage is defined by a plurality of opposed pairs of linkage arms arranged for extension and contraction movement within a wellbore for application of force to the wellbore wall and each of said plurality of pairs of linkage arms extends and contracts responsive to relative linear movement of said force transmitting members; and further comprising power energized tractor mechanisms mounted to each of said opposed pairs of linkage arms and disposed for traction engagement with the wellbore wall for traction movement along the wellbore.

17. A substantially constant force actuator, comprising:

a pair of force transmitting members linearly movable relative to one another from positions of predetermined maximum spacing to positions of predetermined minimum spacing;

a linear force transmitting mechanism forcibly moving said force transmitting members linearly to and from said positions of predetermined maximum spacing and predetermined minimum spacing;

a movement control element located on at least one of said pair of force transmitting members;

at least one pair of linkage arms each having a first end and a second end, said first ends of said linkage arms being pivotally connected to respective ones of said force transmitting members and said second ends of said linkage arms being pivotally interconnected, said at least one pair of linkage arms being angularly positionable at a predetermined minimum angle with said force transmitting members at said predetermined maximum spacing and being positionable at a predetermined maximum angle with said force transmitting members at said predetermined minimum spacing;

a linkage arm guide defined by at least one of said linkage arms and having linkage moving engagement with said movement control element during extension movement of said linkage arms from said predetermined minimum angle to a predetermined intermediate angle; and said force transmitting members transmitting linkage movement force directly to said first and second linkage arms during extension movement of said linkage arms from said predetermined intermediate angle to said predetermined maximum angle.

18. The substantially constant force actuator of claim 17, wherein:

said linkage arm guide defines a guide surface having a predetermined geometry disposed in fixed relation with said at least one linkage arm; and said movement control element forcibly engages said guide surface during movement of said force transmitting members from said predetermined minimum angle to said predetermined intermediate angle.

19. The substantially constant force actuator of claim 18, wherein:

said movement control element comprises at least one wheel rotatably mounted to said at least one of said pair of force transmitting members and imparting linkage moving force to said guide surface and pivotally moving said linkage arms toward said predetermined maximum angle.

20. The substantially constant force actuator of claim 17, further comprising:

a force transmitting element mounted to at least one of said at least one pair of linkage arms and located at least near said second ends of said pair of linkage arms, said force transmitting element transmitting force from said pair or linkage arms in a direction substantially perpendicular to linear movement of said force transmitting members.

21. The substantially constant force actuator of claim 20, further comprising:

a pivot interconnecting said second ends of said at least one pair of linkage arms; and wherein said force transmitting element is a wheel mounted for rotation by said pivot and disposed for force transmitting engagement with an object.

22. The substantially constant force actuator of claim 17, wherein:

each of said force transmitting members defines an elongate pivot slot having a longitudinal axis aligned with said linear movement of said force transmitting members; and further comprising a pivot pin located at said first end of each of said at least one pair of linkage arms and received for linear movement and for pivotal movement by a respective one of said elongate pivot slots.

23. The substantially constant force actuator of claim 17, further comprising:

linkage arm actuator wedges located on each of said at least one pair of linkage arms and each defining a guide surface of predetermined geometry and predetermined orientation with respect to linear movement of said force transmitting members; wherein said movement control element comprises a force transmitting wheel mounted for rotation on each of said force transmitting members and having force transmitting engagement with a guide surface and imparting pivotal movement to said at least one pair of linkage arms responsive to relative linear movement of said force transmitting members;

each of said force transmitting members defines an elongate pivot slot having a longitudinal axis aligned with said linear movement of said force transmitting members; and wherein a pivot pin is located at said first end of each of said at least one pair of linkage arms and is received for linear movement and for pivotal movement by a respective one of said elongate pivot slots.

24. The substantially constant force actuator of claim 17, further comprising:

a force transmitting jack element mounted to at least one of said at least one pair of linkage arms and imparting lifting force to an object.

25. The substantially constant force actuator of claim 17, wherein:

said at least one pair of linkage arms comprises a plurality of pairs of linkage arms; and further comprising a force transmitting centralizer element positioned by each of said pairs of linkage arms for centralizing contact with spaced surfaces.

26. The substantially constant force actuator of claim 17, wherein:

said at least one pair of linkage arms comprises a plurality of pairs of linkage arms; and further comprising a plurality of power energized tractor mechanisms mounted to respective pairs of linkage arms and disposed for force transmitting engagement with a wellbore wall and energized for traction movement along the wellbore wall.

27. The substantially constant force actuator of claim 17, wherein:

said at least one pair of linkage arms comprises a plurality of pairs of linkage arms; and further comprising anchor members mounted to each of said pairs of linkage arms and positioned for anchoring engagement with a wellbore wall.

28. The substantially constant force actuator of claim 17, wherein:

said linear force transmitting mechanism is a fluid pressure energized piston actuator mechanism.

29. The substantially constant force actuator of claim 17, wherein:

said linear force transmitting mechanism comprises at least one spring having spring force transmitting engagement with at least one of said force transmitting members.

30. The substantially constant force actuator of claim 17, further comprising:

a base structure; and wherein said pair of force transmitting members comprise first and second force transmitting members at least one of which is linearly movable relative to said base structure; and wherein said linear force transmitting mechanism has an elongate linear force transmitting element extending between said first and second force transmitting members.

31. A constant force actuator mechanism, comprising;

a pair of force transmitting members, at least one of which is linearly movable to establish relative positions of predetermined maximum and minimum spacing thereof;

a linear force transmitting mechanism moving said at least one force transmitting member linearly to and from said positions of predetermined maximum and minimum spacing;

at least one movement control element located on at least one of said pair of force transmitting members;

at least two pairs of linkage arms, each linkage arm having a first end and a second end, said first ends of said linkage arms being pivotally connected to a respective one of said force transmitting members, said second ends of said linkage arms being pivotally interconnected, said pairs of linkage arms each having angulating movement and being angularly positionable from minimum angles with said force transmitting members at said predetermined maximum spacing to maximum angles with said force transmitting members at said predetermined minimum spacing;

power energized tractor elements mounted to each of said pairs of linkage arms and disposed for force transmitting engagement with a surface for traction movement of said constant force mechanism along the surface; and at least one linkage arm actuator defined by at least one of said linkage arms and having linkage moving engagement with said movement control element during at least a portion of the angulating movement of said linkage arms from said predetermined minimum angle to said predetermined maximum angle.

32. The constant force actuator mechanism of claim 31, wherein:

said power energized tractor elements are powered rotary tractor wheels disposed for gripping relation with opposed spaced surfaces and are rotatable against the opposed surfaces to accomplish traction movement along the opposed spaced surfaces.

33. The constant force actuator mechanism of claim 32, wherein:

said powered rotary tractor wheels are powered rotary cam elements positioned for traction engagement with said opposed spaced surfaces.

34. The constant force actuator mechanism of claim 31, wherein:

said power energized tractor elements are powered rotary endless tractor belts disposed for traction engagement with opposed spaced surfaces and having driving rotation against the opposed spaced surfaces to accomplish said traction movement.

* * * * *